United States Patent [19]

Iiyama et al.

[11] Patent Number: 4,620,205

[45] Date of Patent: Oct. 28, 1986

[54] TWO-COLOR THERMOSENSITIVE RECORDING MATERIAL

[75] Inventors: Kiyotaka Iiyama, Mishima; Nirohiko Inaba, Numazu, both of Japan

[73] Assignee: Ricoh Company, Ltd., Tokyo, Japan

[21] Appl. No.: 781,885

[22] Filed: Sep. 30, 1985

[30] Foreign Application Priority Data

Oct. 3, 1984 [JP] Japan ..... 59-207612

[51] Int. Cl.[4] ..... B41M 5/00

[52] U.S. Cl. ..... 346/204; 346/205; 346/208; 346/226; 427/152

[58] Field of Search ..... 346/201, 204, 205, 206, 346/226, 208, 216–218, 221; 427/150, 151, 152

[56] References Cited

U.S. PATENT DOCUMENTS 3,916,068 10/1975 Kohmura et al. ..... 346/204

FOREIGN PATENT DOCUMENTS 0151388 9/1982 Japan ..... 346/204
0054597 3/1984 Japan ..... 346/204
0105587 6/1985 Japan ..... 346/204
0105588 6/1985 Japan ..... 346/204

*Primary Examiner*—Bruce H. Hess
*Attorney, Agent, or Firm*—Oblon, Fisher, Spivak, McClelland & Maier

[57] ABSTRACT

A two-color thermosensitive recording material comprising a support material, a high temperature color-forming layer comprising a first leuco dye and a first color developer overlaying the support material, a decolorizing layer containing a decolorizing agent overlaying the high temperature color-forming layer, and a low-temperature color-forming layer comprising a second leuco dye and a second color developer overlaying the decolorizing layer, wherein the melting points of the first leuco dye and the first color developer of the high temperature color-forming layer are 150° C. or higher, the melting points of the second leuco dye and the second color developer of the low temperature color-forming layer are 60° C. or higher and the melting point of at least one of the second leuco dye and the second color developer is 130° C. or lower, and the melting point of the decolorizing agent is in the range of 120° C. to 160° C.

13 Claims, No Drawings

TWO-COLOR THERMOSENSITIVE RECORDING MATERIAL

BACKGROUND OF THE INVENTION

The present invention relates to a two-color thermosensitive recording material utilizing coloring reactions between leuco dyes and color developers, by which two different colors are formed on the recording material.

A conventional thermosensitive recording material comprises a support material such as a sheet of paper and a thermosensitive coloring layer formed on the support material, on which thermosensitive coloring layer colored images can be formed by application of heat thereto. For the heat application for image formation, a thermal head is in general use. In such a conventional thermosensitive recording material, there are usually employed in the thermosensitive coloring layer a colorless or light-colored leuco dye containing a lactone ring, a lactam ring or a spiropyran ring, and a color developer which induces color formation in the leuco dye upon application of heat by the reaction with the leuco dye, since it is capable of yielding clear images with minimized fogging.

Because of the capability of forming colored images by simple application of heat, such thermosensitive recording materials are widely used, not only for copying books and documents, but also for recording output information from computers, facsimile apparatus, telex and other information transmission and measuring instruments. Depending upon the recording mode, it will be more convenient if it is allowed to record particular data in a different color from the remainder on a thermosensitive recording material in order to display the particular data more distinctly from the remainder.

Recently, many trials have been made to attain recording with multiple colors by applying heat at different temperatures or by applying different quantities of thermal energy. Accordingly, a variety of multi-color thermosensitive recording sheets have been proposed.

A conventional multi-color thermosensitive recording sheet comprises a support material and two thermosensitive color-forming layers overlaying the support material, which color-forming layers are colored in different colors upon application of different thermal energies thereto respectively. One layer is referred to as, for example, a high-temperature color-forming layer and the other is referred to as, for example, a low-temperature color-forming layer. The low-temperature color-forming layer forms a color at a low temperature, while the high-temperature color-forming layer does not form a color at all at the low temperature, but forms a color at a high temperature which is higher than the low temperature, and the two colors are different from each other.

Such conventional multi-color thermosensitive recording sheets can be roughly classified into the following two types.

In one type, when a high-temperature color-forming layer is colored by application of heat at a high temperature, the color developed in the high-temperature color-forming layer is mixed with the color already developed in a low-temperature color-forming layer, so that a different color from the color in the low-temperature layer is produced in the high-temperature color-forming layer.

In the other type, when the high-temperature color-forming layer is colored, the color in the low-temperature color-forming layer is decolorized by a decolorizing agent, so that only the high-temperature color-forming layer is colored without the color of the low-temperature color-forming layer being mixed therewith.

Specific examples of the former type are disclosed, for instance, in Japanese Patent Publications No. 49-69, No. 49-4342 and No. 49-27708, and Japanese Laid-Open Patent Applications No. 48-86543 and No. 49-65239.

Specific examples of the latter type are disclosed, for instance, in Japanese Patent Publications No. 50-17865, No. 50-17866, No. 51-29024 and No. 51-87542, and Japanese Laid-Open Patent Applications No. 50-18048 and No. 53-47843.

The former type has the shortcoming that the practically developable color systems are limited to such combinations that the color developed at high temperature can overcome the color developed at low temperature, such as red (low temperature)—black (high temperature), and blue (low temperature)—black (high temperature).

In the latter type, there are no particular limitations to the combination of colors. However, a decolorizing agent capable of completely decolorizing the color developed in the low-temperature coloring color-forming layer (when developing a color in the high temperature color-forming layer) has not been discovered, although higher aliphatic alcohols, polyether, polyethylene glycol derivatives, nitrogen-containing compounds such as acetamide, stearamide, phthalonitrile, and amine derivatives such as guanidine derivatives are proposed as such decolorizing agents, so that the separation of the color in the high temperature color-forming layer from the color in the low temperature color-forming layer is incomplete. The result is that the color developed in the low temperature color-forming layer spreads and overlaps the color developed in the high temperature color-forming layer. In order to avoid such problem, it is necessary to overlay a high temperature color-forming layer, a decolorizing layer and a low temperature color-forming layer successively on a support material and to increase the thickness of the decolorizing layer so as to completely decolorize the color developed in the low temperature color-forming layer. However, when such a thick decolorizing layer is formed in the above thermosensitive recording sheet, a large quantity of thermal energy is required for color development in the high temperature color-forming layer by a printer or facsimile apparatus including a thermal head, and the color in the high temperature color-forming layer (located lowermost) cannot always be developed to its full extent in the high speed recording when a high speed recorder is employed, since quick heat transfer in the direction of the depth of the thermosensitive coloring layer is hindered by the depth of the layer.

SUMMARY OF THE INVENTION

It is therefore an object of the present invention to provide a two-color thermosensitive recording material using leuco dyes capable of yielding clear color images with excellent color separation, having high densities, which do not discolor with time.

This object of the present invention can be achieved by a two-color thermosensitive recording material comprising at least a support material, a high temperature color-forming layer comprising a first leuco dye and a first color developer overlaying the support material, a decolorizing layer containing a decolorizing agent overlaying the high temperature color-forming layer, and a low-temperature color-forming layer comprising a second leuco dye and a second color developer overlaying the decolorizing layer, with the key features that the melting points of the first leuco dye and the first color developer of the high temperature color-forming layer are 150° C. or higher, the melting points of the second leuco dye and the second color developer of the low temperature color-forming layer are 60° C. or higher and the melting point of at least one of the second leuco dye and the second color developer is 130° C. or lower, and the melting point of the decolorizing agent is in the range of 120° C. to 160° C.

DETAILED DESCRIPTION OF THE PREFERRED EMBODIMENTS

The present invention is based on the discovery that in a two-color thermosensitive recording material comprising a support material, a high temperature color-forming layer overlaying the support material, a decolorizing layer overlaying the high temperature color-forming layer, and a low-temperature color-forming layer overlaying the decolorizing layer, two unexpectedly clear and stable color images with high image densities can be obtained by adjusting the melting points of the three layer in the above mentioned respective ranges.

In the present invention, when the melting points of the first leuco dye and the first color developer in the high temperature color-forming layer are lower than 150° C., the coloring of the high temperature color-forming layer is initiated when images are developed in the low temperature color-forming layer. Further when the melting points of the second leuco dye and the second color developer contained in the low temperature color-forming layer are both higher than 130° C., coloring of the low temperature color-forming layer is insufficient for practical use. In this case, if applied thermal printing energy is increased, the colored images developed in the low temperature color forming layer are decolorized, so that the image density of the colored images in the low temperature color-forming layer is decreased and at the same time, the coloring of the high temperature color-forming layer is initiated.

When at least one of the second leuco dye and the second color developer in the low temperature color-forming layer has a melting point lower than 60° C., fogging occurs in the background during storage.

When the melting point of the decolorizing agent is lower than 120° C., the decolorizing agent melts when color formation is initiated in the low temperature color-forming layer, so that the color formed in the low temperature color-forming layer is partly decolorized or the density of the formed color is decreased. On the other hand, when the melting point of the decolorizing agent is higher than 160° C., the decolorizing agent does not melt at the time of coloring of the high temperature color-forming layer, so that the color formed in the low temperature color-forming layer is not sufficiently decolorized.

Therefore, the above-described melting point range of each component in the two-color thermosensitive recording material according to the present invention is an indispensable condition for attaining clear and stable two-color recording with excellent color separation.

In the present invention, when necessary, a conventional intermediate layer can be interposed between the decolorizing layer and the low temperature color-forming layer and/or between the decolorizing layer and the high temperature color-forming layer.

In the present invention, it is preferable that the melting point of the leuco dyes for use in the high temperature color-forming layer be 150° C. or higher and the melting point of the leuco dyes for use in the low temperature color-forming layer be in the range of from 60° C. to 150° C. (more preferably not higher than 130° C.). Specific examples of such leuco dyes are as follows:

(1) Leuco Dyes (m.p. 150° C. or more)

3-N-methyl-cyclohexylamino-6-methyl-7-anilinofluoran,
3-diethylamino-7-(o-chloroanilino)fluoran,
3-diethylamino-6-methyl-7-anilinofluoran,
3-diethylamino-5-methyl-7-(N,N-dibenzylamino)fluoran,
3-dibutylamino-7-(o-chloroanilino)fluoran,
3-pyrrolidino-6-methyl-7-anilinoflouran,
3-diethylamino-7-(m-trifluoromethylanilino)fluoran,
3-(N-p-tolyl-N-ethylamino)-6-methyl-7-anilinofluoran,
3-(N-methyl-N-p-tolylamino)-7-anilinofluoran,
3-(N-ethyl-N-isoamylamino)-6-methyl-7-anilinofluoran,
3-diethylamino-5,7-dimethylfluoran,
3-diethylamino-7-chlorofluoran,
3-diethylamino-7-methylfluoran,
3-diethylamino-7,8-benzofluoran,
3-diethylamino-6-methyl-7-chlorofluoran, and
3-diethylamino-5,6-benzofluoran.

(2) Leuco Dyes (m.p. 60° C. to 150° C.)

3-(N-ethyl-N-n-hexylamino)-6-methyl-7-anilinofluoran,
3,3'-bis(2-methyl-1-octyl-3-indolyl)phthalide,
3-(N-ethyl-N-ethoxypropylamino)-7-(m-trifluoromethylmethylanilino)fluoran, diacetylfluorescein, and diacetyl-2,4,5,7-tetrabromofluorescein.

In the present invention, it is preferable that the melting point of the color developers for use in the high temperature color-forming layer be 150° C. or higher and the melting point of the color developers for use in the low temperature color-forming layer be in the range of from 60° C. to 150° C. (more preferably not higher than 130° C.). Specific examples of such decolorizing agents are as follows:

(1) Color Developers (m.p. 150° C. or more)

4,4'-isopropylidenebisphenol,
4,4'-diphenolsulfone,
4,4'-cyclohexylidenebisphenol,
thiobis-(3-tert-butyl-6-methylphenol),
α-naphthyl p-hydroxybenzoate,
2-hydroxy-3-naphthoic acid,
zinc 2-hydroxy-3-naphthoate,
3,5-di-tert-butylsalicylic acid,
salicyl-m-trifluoromethylanilide, and
p-chlorobenzyl p-hydroxybenzoate.

(2) Color Developers (m.p. 60° C. to 150° C.)

benzyl p-hydroxybenzoate,
methylbenzyl p-hydroxybenzoate,
isobutyl p-hydroxybenzoate,
octyl p-hydroxybenzoate,
di(m-chlorophenyl)-thiourea,
di(m-trifluoromethylphenyl)thiourea,
thiobis(3-methylphenol),
methylenebis-(oxyethylenethio)diphenol,
1,5-di(4-hydroxyphenylthio)pentane-3-on, 4,4'-isopropylidenebis-(3-chlorophenol),
4,4'-isopropylidenebis-(3-isopropylphenol), and
4,4'-isopropylidenebis-(3-tert-butylphenol).

The decolorizing agents for use in the present invention have melting points ranging from 120° C. to 160° C. Specific examples of such decolorizing agents are as follows:

N,N'-dithiodimorpholine,
N,N'-dithiodipiperidine,
N,N'-dithiodipiperazine,
N,N'-dithio-di-δ-caprolactam,
N,N'-dithio-di-pyrrolidone-2,
N,N'-dithiobenzthiazol,
N,N'-dithio-morpholino-benzthiazol,
N,N'-thiodimorpholine, and
N,N'-thio-di-ε-caprolactam.

As mentioned previously, in the present invention, when necessary, a conventional intermediate layer can be interposed between the decolorizing layer and the low temperature color-forming layer and/or between the decolorizing layer and the high temperature color-forming layer. The intermediate layer can be made of, for example, a water-soluble resin, a latex, a filler pigment and a thermo-fusible material.

Further, in the present invention, a protective layer can be formed on the top surface of the two-color thermosensitive recording material, mainly for the purpose of improving the thermal head-matching properties and resistance to chemicals. Usually it is made of a water-soluble resin, a latex and a filler pigment.

In the present invention, a wide variety of conventional binder agents can be employed for binding and supporting the above-mentioned leuco dyes, color developers, and decolorizing agents.

Examples of the binder agents are as follows: polyvinyl alcohol; starch and starch derivatives; cellulose derivatives such as methoxycellulose, hydroxyethylcellulose, carboxymethylcellulose, methylcellulose and ethylcellulose; water-soluble polymeric materials such as sodium polyacrylate, polyvinylpyrrolidone, acrylamide/acrylic acid ester copolymer, acrylamide/acrylic acid ester/methacrylic acid three-dimensional copolymer, styrene/maleic anhydride copolymer alkali salt, isobutylene/maleic anhydride copolymer alkali salt, polyacrylamide, sodium alginate, gelatin and casein; and latexes of polyvinyl acetate, polyurethane, styrene/butadiene copolymer, polyacrylic acid, polyacrylic acid ester, vinyl chloride/vinyl acetate copolymer, polybutylmethacrylate, ethylene/vinyl acetate copolymer and styrene/butadiene/acryl-type copolymer.

In the present invention, when necessary, auxiliary additives which are conventionally employed in the thermosensitive recording materials of this type, for example, fillers, surface active agents and thermo-fusible materials, can be added to the above mentioned leuco dyes and color developers.

Specific examples of the fillers are calcium carbonate, silica, zinc oxide, titanium oxide, aluminum hydroxide, zinc hydroxide, barium sulfate, clay, talc, surface-treated inorganic powder, for example, of calcium and silica, and powder of organic materials, such as urea-formaldehyde resin, urea-guanamine resin, styrene/methacrylic acid copolymer and polystyrene.

Specific examples of the thermo-fusible materials are higher fatty acids, amides, esters and metal salts of higher fatty acids, higher alcohols and esters thereof, higher fatty amines and amides, animal, vegetable and mineral waxes, dialkyl 3,4-epoxy-hexahydrophthalate and higher ketones.

The thermosensitive recording material according to the present invention can be prepared, for example, by successively applying to a support material such as a sheet of paper and synthetic paper (1) a high temperature color-forming layer formation liquid, (2) a decolorizing layer formation liquid and (3) a low temperature color-forming layer liquid and drying the same, each layer containing the above mentioned necessary components. When overlaying one layer on the other layer, sufficient care must be taken with respect to the co-solubilities and peeling-off properties of the two layer formation liquids so that the upper layer does not mix with the lower layer. The upper layer can be formed after the lower layer was dried and subjected to calendering.

It is preferable that the amount of the first leuco dye in the high temperature color-forming layer be in the range of from 0.3 g/m$^2$ to 1.0 g/m$^2$ when dried, and the ratio by weight of the dye to the color developer in the high temperature color-forming layer be (1:1) to (1:5).

It is preferable that the amount of the decolorizing agent in the decolorizing layer be in the range of from 0.5 g/m$^2$ to 10 g/m$^2$.

With respect to the deposition of the low temperature color-forming layer, the more, the better, for increasing the density of the developed images in the low temperature color-forming layer. However, for enhancing the decolorizing effect and reducing the cost of the two-color thermosensitive recording material, the smaller, the better. Usually, it is preferable that the deposition amount of the leuco dye in the low temperature color-forming layer be in the range of from 0.2 g/m$^2$ to 0.6 g/m$^2$ and the ratio by weight of the leuco dye to the color developer in the low temperature color-forming layer be in the range of from (1:1) to (1:3).

When a protective layer is formed on the top surface of the two-color thermosensitive recording material according to the present invention, it is preferable that the protective layer be deposited in an amount ranging from 0.5 g/m$^2$ to 5.0 g/m$^2$ when dried.

When an intermediate layer is interposed between the decolorizing layer and the low temperature color-forming layer, it is preferable that the intermediate layer be deposited in an amount ranging from 0.5 g/m$^2$ to 4.0 g/m$^2$.

When an intermediate layer is interposed between the decolorizing layer and the high temperature color-forming layer, it is preferable that the intermediate layer be deposited in an amount ranging from 1 g/m$^2$ to 10 g/m$^2$.

By referring to the following examples, the present invention will now be explained in detail.

EXAMPLE 1

The following liquids were prepared by grinding the respective components in a ball mill.

| | Parts by Weight |
|---|---|
| Liquid A-1 | |
| Dye A-1 in Table 1 3-diethylamino-6-chlorofluoran (m.p. 180° C.) | 10 |
| 10% aqueous solution of hydroxyethylcellulose | 10 |
| Water | 30 |
| Liquid A-2 | |
| Dye A-2 in Table 1 3-dibutylamino-7-(o-chloroanilino)- | 10 |

-continued

| | Parts by Weight |
|---|---|
| fluoran (m.p. 185° C.) | |
| 10% aqueous solution of hydroxyethyl-cellulose | 10 |
| Water | 30 |
| Liquid B-1 | |
| Color Developer B-1 in Table 1 4,4'-cyclohexylidenebisphenol (m.p. 180° C.) | 30 |
| 10% aqueous solution of hydroxyethyl-cellulose | 30 |
| Water | 90 |
| Liquid B-2 | |
| Color Developer B-2 in Table 1 di-(m-chlorophenyl)thiourea (m.p. 125° C.) | 20 |
| 10% aqueous solution of hydroxyethyl-cellulose | 20 |
| Water | 60 |
| Liquid C | |
| Calcium carbonate | 20 |
| 5% aqueous solution of methylcellulose | 20 |
| SBR - Latex (solid components 43%) | 10 |
| Water | 50 |
| Liquid D | |
| Decolorizing Compound D in Table 1 | 100 |
| N,N'-dithiobismorpholine (m.p. 122° C.) | 100 |
| 10% aqueous solution of polyvinyl alcohol | 100 |
| Water | 300 |
| Liquid E | |
| Compound E in Table 1 Benzyl p-methoxybenzoate | 10 |
| 10% polyvinyl alcohol | 20 |
| Water | 60 |
| Liquid F | |
| 10% polyvinyl alcohol | 10 |
| Silica | 10 |
| Zinc stearate | 1 |
| Boric acid | 5 |
| Water | 104 |

Liquid A-1, Liquid B-1 and Liquid C were mixed with a mixing ratio of 1:1:1 by weight, so that a high temperature color-forming layer formation liquid was prepared. The thus prepared high temperature color-forming layer formation liquid was uniformly coated on a sheet of high quality paper (about 50 g/m$^2$ of basis weight) so as to form a high temperature color-forming layer with a deposition of 0.5 g/m$^2$ of the leuco dye, so that a high temperature color-forming layer was formed on the paper.

When the high temperature color-forming layer was completely dried, Liquid D serving as a decolorizing layer formation liquid was coated on the high temperature color-forming layer, with a deposition of 4 g/m$^2$ when dried, so that a decolorizing layer was formed on the high temperature color-forming layer.

An intermediate layer formation liquid consisting of polyvinyl alcohol and a high density polyethylene wax (softening point 130° C.) with a mixing ratio of 1:1 by weight was prepared and was then coated on the decolorizing layer with a deposition of 2.5 g/m$^2$ when dried, so that an intermediate layer was formed on the decolorizing layer.

Liquid A-2, Liquid B-2, Liquid C and Liquid E were mixed with a mixing ratio of 1:1:1:1 by weight, so that a low temperature color-forming layer formation liquid was prepared. Benzyl p-methoxybenzoate contained in Liquid E served to sensitize the low temperature color-forming layer. The thus prepared low temperature color-forming layer formation liquid was coated on the intermediate layer with a deposition of 0.45 g/m$^2$ of the leuco dye, so that a low temperature color-forming layer was formed on the intermediate layer.

When the low temperature color-forming layer was completely dried, Liquid F was coated on the low temperature color-forming layer with a deposition of 3 g/m$^2$ when dried, whereby a two-color thermosensitive recording material No. 1 according to the present invention was prepared.

Thermal printing was performed on the two-color thermosensitive recording material No. 1 by use of a facsimile apparatus, with application of 0.8 mJ/dot of thermal printing energy for low-temperature coloring, and with application of 2.7 mJ/dot of thermal printing energy for high-temperature coloring.

As a result, a clear black colored image having an image density of 1.0 was obtained at the low temperature coloring, and at the high temperature coloring, a clear orange red colored image having an image density of 1.0 was obtained, with clear-cut color separation from the black color developed at the low temperature coloring. These two color images had high contrast with the white background of this thermosensitive recording material and remained stable when they were allowed to stand in an ordinary room for several weeks.

EXAMPLE 2

Example 1 was repeated except that 3-diethylamino-6-chlorofluoran employed as Dye A-1 in Liquid A-1 was replaced by 3-diethylamio-7-chlorofluoran (m.p. 180° C.), and 4,4'-cyclohexylidenebisphenol (m.p. 180° C.) employed as Color Developer B-1 in Liquid B-1 was replaced by bisphenol S (m.p. 245° C.) as summarized in Table 1, whereby a two-color thermosensitive recording material No. 2 according to the present invention was prepared. The recording material was also subjected to the same thermal printing test as in Example 1.

The result was that a clear black colored image having high image density was obtained at the low temperature coloring, and at the high temperature coloring, a clear orange yellow colored image was obtained, with clear-cut color separation from the black color developed at the low temperature coloring. These two color images had high contrast with the white background of this thermosensitive recording material. The thus developed images remained stable and did not deteriorate with time.

EXAMPLE 3

Example 1 was repeated except that 3-diethylamino-6-chlorofluoran employed as Dye A-1 in Liquid A-1 was replaced by a mixture of 3-diethylamio-6-chlorofluoran and 3-diethylamino-7,8-benzofluoran with a mixing ratio of 1:1 by weight, 4,4'-cyclohexylidenebisphenol employed as Color Developer B-1 in Liquid B-1 was replaced by Bisphenol S (m.p. 245° C.), and benzyl p-methoxybenzoate employed as Compound E in Liquid E was replaced by p-benzylbiphenyl as shown in Table 1, whereby a two-color thermosensitive recording material No. 3 according to the present invention was prepared. The recording material was also subjected to the same thermal printing test as in Example 1.

The result was that a clear black colored image having high image density was obtained at the low temperature coloring, and at the high temperature coloring, a clear orange red colored image was obtained, with clear-cut color separation from the black color developed at the low temperature coloring. These two color images had high contrast with the white background of this thermosensitive recording material. The thus developed images remained stable and did not deteriorate with time.

EXAMPLES 4 TO 7

With the formulations as summarized in Table 1, two-color thermosensitive recording materials Nos. 4 through 7 were prepared in the same manner as in Example 1.

The recording materials were subjected to the same thermal printing test as in Example 1.

The result was that each thermosensitive recording material yielded a clear black colored image having high image density at the low temperature coloring, and at the high temperature coloring, a clear orange red colored image was obtained, with clear-cut color separation from the black color developed at the low temperature coloring. These two color images had high contrast with the white background of this thermosensitive recording material. The thus developed images remained stable and did not deteriorate with time.

TABLE 1

| | |
|---|---|
| Example 1 | |
| Dye A-1 | 3-diethylamino-6-chlorofluoran (m.p. 180° C.) |
| Dye A-2 | 3-dibutylamino-7-(o-chloroanilino) fluoran (m.p. 185° C.) |
| Color Developer B-1 | 4,4'-cyclohexylidenebisphenol (m.p. 180° C.) |
| Color Developer B-2 | di-(m-chlorophenyl)thiourea (m.p. 125° C.) |
| Decolorizing Compound | N,N'—dithiobismorpholine (m.p. 122° C.) |
| Compound E | Benzyl p-methoxybenzoate |
| Example 2 | |
| Dye A-1 | 3-diethylamino-7-chlorofluoran (m.p. 178° C.) |
| Dye A-2 | 3-dibutylamino-7-(o-chloroanilino) fluoran (m.p. 185° C.) |
| Color Developer B-1 | Bisphenol S (m.p. 245° C.) |
| Color Developer B-2 | di-(m-chlorophenyl)thiourea (m.p. 125° C.) |
| Decolorizing Compound | N,N'—dithiobismorpholine (m.p. 122° C.) |
| Compound E | Benzyl p-methoxybenzoate |
| Example 3 | |
| Dye A-1 | Mixture of 3-diethylamino-6-chlorofluoran and 3-diethylamino-7,8-benzofluoran (1:1) |
| Dye A-2 | 3-dibutylamino-7-(o-chloroanilino) fluoran (m.p. 185° C.) |
| Color Developer B-1 | Bisphenol S (m.p. 245° C.) |
| Color Developer B-2 | di-(m-chlorophenyl)thiourea (m.p. 125° C.) |
| Decolorizing Compound | N,N'—dithiobismorpholine (m.p. 122° C.) |
| Compound E | p-benzylbiphenyl |
| Example 4 | |
| Dye A-1 | Mixture of 3-diethylamino-6-chlorofluoran and 3-diethylamino-7,8-benzofluoran (1:1) |
| Dye A-2 | 3-(N—methyl-N—cyclohexylamino)-6-methyl-7-anilinofluoran (m.p. 208° C.) |
| Color Developer B-1 | 4,4'-thiobis-(6-methyl-3-tert-butylphenol (m.p. 160° C.) |
| Color Developer B-2 | Benzyl p-hydroxybenzoate (m.p. 112° C.) |
| Decolorizing Compound | N,N'—dithio-di-ε-caprolactam (m.p. 135° C.) |
| Compound E | 3,5,3',5'-tetrabromobisphenol A |
| Example 5 | |
| Dye A-1 | Mixture of 3-diethylamino-6-chlorofluoran and 3-diethylamino-7,8-benzofluoran (1:1) |
| Dye A-2 | 3-(N—ethyl-N—isoacylamino)-6-methyl-7-anilinofluoran (m.p. 166° C.) |
| Color Developer B-1 | 4,4'-cyclohexylidenebisphenol (m.p. 180° C.) |
| Color Developer B-2 | 4,4'-methylenebis(oxyethylene-thio)diphenol (m.p. 108° C.) |
| Decolorizing Compound | N,N'—dithio-di-ε-caprolactam (m.p. 135° C.) |
| Compound E | 3,5,3',5'-tetrabromobisphenol S |
| Example 6 | |
| Dye A-1 | Mixture of 3-diethylamino-6-chlorofluoran and 3-diethylamino-7,8-benzofluoran (1:1) |
| Dye A-2 | 3-dibutylamino-7-(o-chloroanilino) fluoran (m.p. 185° C.) |
| Color Developer B-1 | 4,4'-cyclohexylidenebisphenol (m.p. 180° C.) |
| Color Developer B-2 | di(m-chlorophenyl)thioura (m.p. 125° C.) |
| Decolorizing Compound | Tetramethyl thiuram disulfide (m.p. 145° C.) |
| Compound E | Benzyl p-methoxybenzoate |
| Example 7 | |
| Dye A-1 | Mixture of 3-diethylamino-6-chlorofluoran and 3-diethylamino-7,8-benzofluoran (1:1) |
| Dye A-2 | 3-dibutylamino-7-(o-chloroanilino) fluoran (m.p. 185° C.) |
| Color Developer B-1 | 4,4'-cyclohexylidenebisphenol (m.p. 180° C.) |
| Color Developer B-2 | di(m-chlorophenyl)thioura (m.p. 125° C.) |
| Decolorizing Compound | di-(o-benzamidephenyl)disulfide (m.p. 140° C.) |
| Compound E | Benzyl p-methoxybenzoate |

COMPARATIVE EXAMPLE 1

With the formulations as summarized in Table 2, comparative two-color thermosensitive recording materials Nos. 1 and 2 were prepared in the same manner as in Example 1.

These comparative recording materials were subjected to the same thermal printing test as in Example 1.

The result was that each comparative thermosensitive recording material yielded a clear red colored image at high temperature coloring. However, in the images developed at low temperature coloring, red and black colors were mixed, so that clear-cut color separation was not attained.

COMPARATIVE EXAMPLE 3

With the formulation as summarized in Table 2, a comparative two-color thermosensitive recording material No. 3 was prepared in the same manner as in Example 1.

This comparative recording material was subjected to the same thermal printing test as in Example 1.

The result was that a clear black colored image was obtained at low temperature coloring. However, in the images developed at high temperature coloring, red and black colors were mixed, so that clear-cut color separation was not attained.

COMPARATIVE EXAMPLE 4

With the formulation as summarized in Table 2, a comparative two-color thermosensitive recording material No. 4 was prepared in the same manner as in Example 1.

This comparative recording material was subjected to the same thermal printing test as in Example 1.

The result was that a clear red image was obtained at high temperature coloring. However, the images developed at low temperature coloring had a low image density and the developed images completely disappeared with time.

COMPARATIVE EXAMPLE 5

With the formulation as summarized in Table 2, a comparative two-color thermosensitive recording material No. 5 was prepared in the same manner as in Example 1.

This comparative recording material was subjected to the same thermal printing test as in Example 1.

The result was that the colored image obtained at low temperature coloring had an extremely low image density, and in the images developed at high temperature coloring, red and black colors were mixed, so that clear-cut color separation was not attained.

TABLE 2

| | |
|---|---|
| Comparative Example 1 | |
| Dye A-1 | 3-diethylamino-6-chlorofluoran (m.p. 180° C.) |
| Dye A-2 | 3-dibutylamino-7-(o-chloroanilino) fluoran (m.p. 185° C.) |
| Color | Benzyl p-hydroxybenzoate |
| Developer B-1 | (m.p. 112° C.) |
| Color | di-(m-chlorophenyl)thiourea |
| Developer B-2 | (m.p. 125° C.) |
| Decolorizing | N,N'—dithiobismorpholine |
| Compound | (m.p. 122° C.) |
| Compound E | Benzyl p-methoxybenzoate |
| Comparative Example 2 | |
| Dye A-1 | 3,3'-bis(2-methyl-1-octyl-3-indolyl) phthalide (m.p. 82° C.) |
| Dye A-2 | 3-dibutylamino-7-(o-chloroanilino) fluoran (m.p. 185° C.) |
| Color | Bisphenol S |
| Developer B-1 | (m.p. 245° C.) |
| Color | di-(m-chlorophenyl)thiourea |
| Developer B-2 | (m.p. 125° C.) |
| Decolorizing | N,N'—dithiobismorpholine |
| Compound | (m.p. 122° C.) |
| Compound E | Benzyl p-methoxybenzoate |
| Comparative Example 3 | |
| Dye A-1 | Mixture of 3-diethylamino-6-chlorofluoran and 3-diethylamino-7,8-benzofluoran (1:1) |
| Dye A-2 | 3-dibutylamino-7-(o-chloroanilino) fluoran (m.p. 185° C.) |
| Color | Bisphenol S |
| Developer B-1 | (m.p. 245° C.) |
| Color | di-(m-chlorophenyl)thiourea |
| Developer B-2 | (m.p. 125° C.) |
| Decolorizing | 2-benzothiazolyldisulfide |
| Compound | (m.p. 170° C.) |
| Compound E | Benzyl p-methoxybenzoate |
| Comparative Example 4 | |
| Dye A-1 | Mixture of 3-diethylamino-6-chlorofluoran and 3-diethylamino-7,8-benzofluoran (1:1) |
| Dye A-2 | 3-dibutylamino-7-(o-chloroanilino) fluoran (m.p. 185° C.) |
| Color | Bisphenol S |
| Developer B-1 | (m.p. 245° C.) |
| Color | di-(m-chlorophenyl)thiourea |
| Developer B-2 | (m.p. 125° C.) |
| Decolorizing | dipentamethylene thiuram tetrasulfide (m.p. 110° C.) |
| Compound E | Benzyl p-methoxybenzoate |
| Comparative Example 5 | |
| Dye A-1 | Mixture of 3-diethylamino-6-chlorofluoran and 3-diethylamino-7,8-benzofluoran (1:1) |
| Dye A-2 | 3-dibutylamino-7-(o-chloroanilino) fluoran (m.p. 185° C.) |
| Color | Bisphenol S |
| Developer B-1 | (m.p. 245° C.) |
| Color | 4,4'-cyclohexylidenebisphenol |
| Developer B-2 | (m.p. 180° C.) |
| Decolorizing | N,N'—dithiobismorpholine |
| Compound | (m.p. 122° C.) |
| Compound E | None |

What is claimed is:

1. A two-color thermosensitive recording material, comprising:

a support material;

a high temperature color-forming layer comprising a first leuco dye and a first color developer each having a melting point of at least 150° C.;

a decolorizing layer containing a decolorizing agent having a melting point in the range of 120° C. to 160° C. overlaying the high temperature color-forming layer; and a low temperature color-forming layer comprising a second leuco dye and a second color developer each having a melting point of at least 60° C. with the melting point of at least one of said second leuco dye or second color developer being no more than 130° C.

2. The two-color thermosensitive recording material as claimed in claim 1, wherein said first leuco dye is selected from the group consisting of:

3-N-methyl-cyclohexylamino-6-methyl-7-anilinofluoran,
3-diethylamino-7-(o-chloroanilino)fluoran,
3-diethylamino-6-methyl-7-anilinofluoran,
3-diethylamino-5-methyl-7-(N,N-dibenzylamino)fluoran,
3-dibutylamino-7-(o-chloroanilino)fluoran,
3-pyrrolidino-6-methyl-7-anilinoflouran,
3-diethylamino-7-(m-trifluoromethylanilino)fluoran,
3-(N-p-tolyl-N-ethylamino)-6-methyl-7-anilinofluoran,
3-(N-methyl-N-p-tolylamino)-7-anilinofluoran,
3-(N-ethyl-N-isoamylamino)-6-methyl-7-anilinofluoran,
3-diethylamino-5,7-dimethylfluoran,
3-diethylamino-7-chlorofluoran,
3-diethylamino-7-methylfluoran,
3-diethylamino-7,8-benzofluoran,
3-diethylamino-6-methyl-7-chlorofluoran, and
3-diethylamino-5,6-benzofluoran.

3. The two-color thermosensitive recording material as claimed in claim 1, wherein said second leuco dye is selected from the group consisting of:

3-(N-ethyl-N-n-hexylamino)-6-methyl-7-anilinofluoran,
3,3'-bis(2-methyl-1-octyl-3-indolyl)phthalide,
3-(N-ethyl-N-ethoxypropylamino)-7-(m-trifluoromethylmethylanilino)fluoran,
diacetylfluorescein, and
diacetyl-2,4,5,7-tetrabromofluorescein.

4. The two-color thermosensitive recording material as claimed in claim 1, wherein said first color developer is selected from the group consisting of:
4,4'-isoproylidenebisphenol,
4,4'-diphenolsulfone,
4,4'-cyclohexylidenebisphenol,
thiobis-(3-tert-butyl-6-methylphenol),
α-naphthyl p-hydroxybenzoate,
2-hydroxy-3-naphthoic acid,
zinc 2-hydroxy-3-naphthoate,
3,5-di-tert-butylsalicylic acid,
salicyl-m-trifluoromethylanilide, and
p-chlorobenzyl p-hydroxybenzoate.

5. The two-color thermosensitive recording material as claimed in claim 1, said second color developer is selected from the group consisting of:
benzyl p-hydroxybenzoate,
methylbenzyl p-hydroxybenzoate,
isobutyl p-hydroxybenzoate,
octyl p-hydroxybenzoate,
di(m-chlorophenyl)-thiourea,
di(m-trifluoromethylphenyl)thiourea,
thiobis(3-methylphenol),
methylenebis-(oxyethylenethio)diphenol,
1,5-di(4-hydroxyphenylthio)pentane-3-on,
4,4'-isopropylidenebis-(3-chlorophenol),
4,4'-isopropylidenebis-(3-isopropylphenol), and
4,4'-isopropylidenebis-(3-tert-butylphenol).

6. The two-color thermosenstive recording material as claimed in claim 1, wherein said decolorizing agent is selected from the group consisting of:
N,N'-dithiodimorpholine,
N,N'-dithiodipiperidine,
N,N'-dithiodipiperazine,
N,N'-dithio-di-ε-caprolactam,
N,N'-dithio-di-pyrrolidone-2,
N,N'-dithiobenzthiazol,
N,N'-dithio-morpholino-benzthiazol,
N,N'-thiodimorpholine, and
N,N'-thio-di-ε-caprolactam.

7. The two-color thermosensitive recording material as claimed in claim 1, further comprising an intermediate layer interposed between said high temperature color-forming layer and said decolorizing layer and/or between said decolorizing layer and said low temperature color-forming layer.

8. The two-color thermosensitive recording material as claimed in claim 7, wherein said intermediate layer is interposed between said high temperature color-forming layer and said decolorizing layer in an amount ranging from 1 $g/m^2$ to 10 $g/m^2$.

9. The two-color thermosensitive recording material as claimed in claim 7, wherein said intermediate layer is interposed between said decolorizing layer and said low temperature color-forming layer in an amount ranging from 0.5 $g/m^2$ to 5.0 $g/m^2$.

10. The two-color thermosensitive recording material as claimed in claim 1, further comprising a protective layer formed on said low temperature color-forming layer.

11. The two-color thermosensitive recording material as claimed in claim 1, wherein said first leuco dye is deposited in an amount ranging from 0.3 $g/m^2$ to 1.0 $g/m^2$, and the ratio of said first leuco dye to first color developer in said high temperature color-forming layer is in the range of from (1:1) to (1:5) by weight.

12. The two-color thermosensitive recording material as claimed in claim 1, wherein said decolorizing agent is deposited in an amount ranging from 0.5 $g/m^2$ to 10 $g/m^2$.

13. The two-color thermosensitive recording material as claimed in claim 1, wherein said second leuco dye is deposited in an amount ranging from 0.2 $g/m^2$ to 0.6 $g/m^2$, and the ratio of said second leuco dye to said second color developer in said low temperature color-forming layer is in the range of from (1:1) to (1:3) by weight.

* * * * *